US007392814B2

(12) United States Patent
Hasegawa et al.

(10) Patent No.: US 7,392,814 B2
(45) Date of Patent: Jul. 1, 2008

(54) SUBSTRATE PROCESSING APPARATUS AND METHOD

(75) Inventors: Koji Hasegawa, Kyoto (JP); Masato Tanaka, Kyoto (JP); Ayumi Higuchi, Kyoto (JP); Kenichiro Arai, Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 0 days.

(21) Appl. No.: 11/317,971

(22) Filed: Dec. 23, 2005

(65) Prior Publication Data

US 2006/0137719 A1 Jun. 29, 2006
US 2007/0235064 A9 Oct. 11, 2007

(30) Foreign Application Priority Data

Dec. 24, 2004 (JP) ..... 2004-372959
Dec. 24, 2004 (JP) ..... 2004-372960

(51) Int. Cl.
*B08B 3/12* (2006.01)

(52) U.S. Cl. ..... 134/102.1; 134/184; 134/186

(58) Field of Classification Search ..... 134/1, 134/25.4, 34, 21, 36, 94.1, 100.1, 102.1, 134/902, 184, 186
See application file for complete search history.

(56) References Cited

U.S. PATENT DOCUMENTS

| | | | | |
|---|---|---|---|---|
| 6,138,698 | A * | 10/2000 | Tanaka et al. | 134/184 |
| 6,454,867 | B1 * | 9/2002 | Bourdat | 134/1 |
| 6,796,315 | B2 * | 9/2004 | Lu et al. | 134/1.3 |
| 7,104,268 | B2 * | 9/2006 | Wu et al. | 134/1.3 |
| 2001/0023700 | A1 * | 9/2001 | Drayer et al. | 134/1.3 |
| 2002/0011253 | A1 * | 1/2002 | Puri et al. | 134/1 |
| 2003/0205559 | A1 * | 11/2003 | Hansen et al. | 216/108 |
| 2004/0134513 | A1 * | 7/2004 | Lu et al. | 134/1 |
| 2004/0152319 | A1 * | 8/2004 | Yamagata et al. | 438/689 |
| 2004/0226654 | A1 | 11/2004 | Hongo et al. | |

FOREIGN PATENT DOCUMENTS

| | | |
|---|---|---|
| JP | 7-58078 | 3/1995 |
| JP | 9-69508 | 3/1997 |
| JP | 2005-45159 | 2/2005 |
| JP | 2005-93733 | 4/2005 |

* cited by examiner

*Primary Examiner*—Joseph L Perrin
(74) *Attorney, Agent, or Firm*—Ostrolenk, Faber, Gerb & Soffen, LLP

(57) ABSTRACT

Pure water dissolving nitrogen gas and containing microbubbles is supplied to a substrate. Since microbubbles are very minute in size and also have the electrostatic property, they can efficiently adsorb particles on the substrate surface or in the pure water. Further, since pure water dissolving nitrogen gas is unlikely to be charged, the pure water itself never carries new particles from each component of the apparatus. These functions allow efficient particle removal from the substrate surface or the liquid.

3 Claims, 12 Drawing Sheets

SUBSTRATE PROCESSING APPARATUS AND METHOD

BACKGROUND OF THE INVENTION

1. Field of the Invention

The present invention relates to a technique for removing particles from substrate surfaces or liquids in a substrate processing apparatus for processing substrates, such as semiconductor substrates and glass substrates for liquid crystal displays or for photomasks, using liquids.

2. Description of the Background Art

In the substrate manufacturing process, there are conventionally known substrate processing apparatuses for performing predetermined processing on substrates by supplying liquids such as pure water and chemical solutions to the substrates. There are mainly two types of such substrate processing apparatuses: batch substrate processing apparatuses for processing a plurality of substrates at a time which are immersed together in a liquid retained in a processing bath; and single-substrate processing apparatuses for processing a single substrate held by a holder one by one by discharging a liquid onto the substrate surface.

Those substrate processing apparatuses remove particles attached on substrates or floating in liquids as appropriate. Particles are usually removed by forming liquid flows along substrate surfaces and carrying particles by the action of the liquid flows. In some cases, particles are removed by supplying bubbles in liquids to adsorb particles on the bubbles and carry them together.

However, there is a certain limit on the efficiency of particle removal by only using the action of liquid flows. Further, even in the case of using bubbles, bubble sizes usually generated with a bubbler are overwhelmingly larger than particle sizes and thus not optimum for particle removal. In recent years, the level of particles allowed in substrate processing is becoming higher. Accordingly, more efficient techniques for particle removal are required.

SUMMARY OF THE INVENTION

The present invention is directed to a substrate processing apparatus for processing a substrate using a liquid.

According to an aspect of the present invention, the substrate processing apparatus includes a holder holding a substrate; a liquid supplier supplying a liquid to the substrate held by the holder; a gas dissolver dissolving a predetermined gas in the liquid supplied from the liquid supplier; and a microbubble generator generating microbubbles in the liquid supplied from the liquid supplier.

Particles on the substrate surface or in the liquid are adsorbed on and carried with microbubbles to be removed. Since microbubbles are very minute in size, they as a whole have a large surface area and thus can efficiently adsorb particles. Besides, since microbubbles have the electrostatic property, they can attract particles also by electrostatic action and thus can efficiently adsorb particles. Further, since a predetermined gas is dissolved in the liquid, the liquid itself is unlikely to be charged. This prevents the liquid from absorbing new particles from each component of the apparatus and attaching those particles to the substrate. Those functions allow efficient particle removal.

According to another aspect of the present invention, the substrate processing apparatus includes a processing bath retaining a liquid; a holder holding a substrate being immersed in the liquid in the processing bath; a liquid supplier supplying a liquid in the processing bath; an ultrasonic vibration applicator applying ultrasonic vibrations to the liquid retained in the processing bath; and a microbubble generator generating microbubbles in the liquid supplied from the liquid supplier to the processing bath.

Particles are liberated from the substrate under the impact of ultrasonic vibrations and adsorbed on and removed with microbubbles. Since microbubbles are very minute in size, they as a whole have a large surface area and thus can efficiently adsorb particles. Besides, since microbubbles have the electrostatic property, they can attract particles also by electrostatic action and thus can efficiently adsorb particles. Further, since ultrasonic vibrations are applied around the substrate with the supply of microbubbles, the excessive impact of ultrasonic vibrations can be absorbed into the microbubbles. This reduces the damage on the substrate.

Preferably, the substrate processing apparatus further includes a gas dissolver dissolving a predetermined gas in the liquid supplied from the liquid supplier to the processing bath.

Dissolving a predetermined gas in the liquid inhibits charging of the liquid. This prevents the liquid from absorbing new particles from each component of the apparatus and attaching those particles to the substrate.

Preferably, a liquid flow is formed along the substrate surface.

This allows microbubbles adsorbing particles to be actively carried along with the liquid flow, thereby achieving efficient particle removal.

The present invention is also directed to a particle removal method of removing particles from a substrate surface or a liquid.

Therefore, it is an object of the present invention to provide a technique for efficiently removing particles from a substrate surface or a liquid in the substrate processing apparatus.

These and other objects, features, aspects and advantages of the present invention will become more apparent from the following detailed description of the present invention when taken in conjunction with the accompanying drawings.

DESCRIPTION OF THE PREFERRED EMBODIMENTS

Hereinbelow, preferred embodiments of the present invention will be described with reference to the drawings.

1. First Preferred Embodiment

Figure 1:
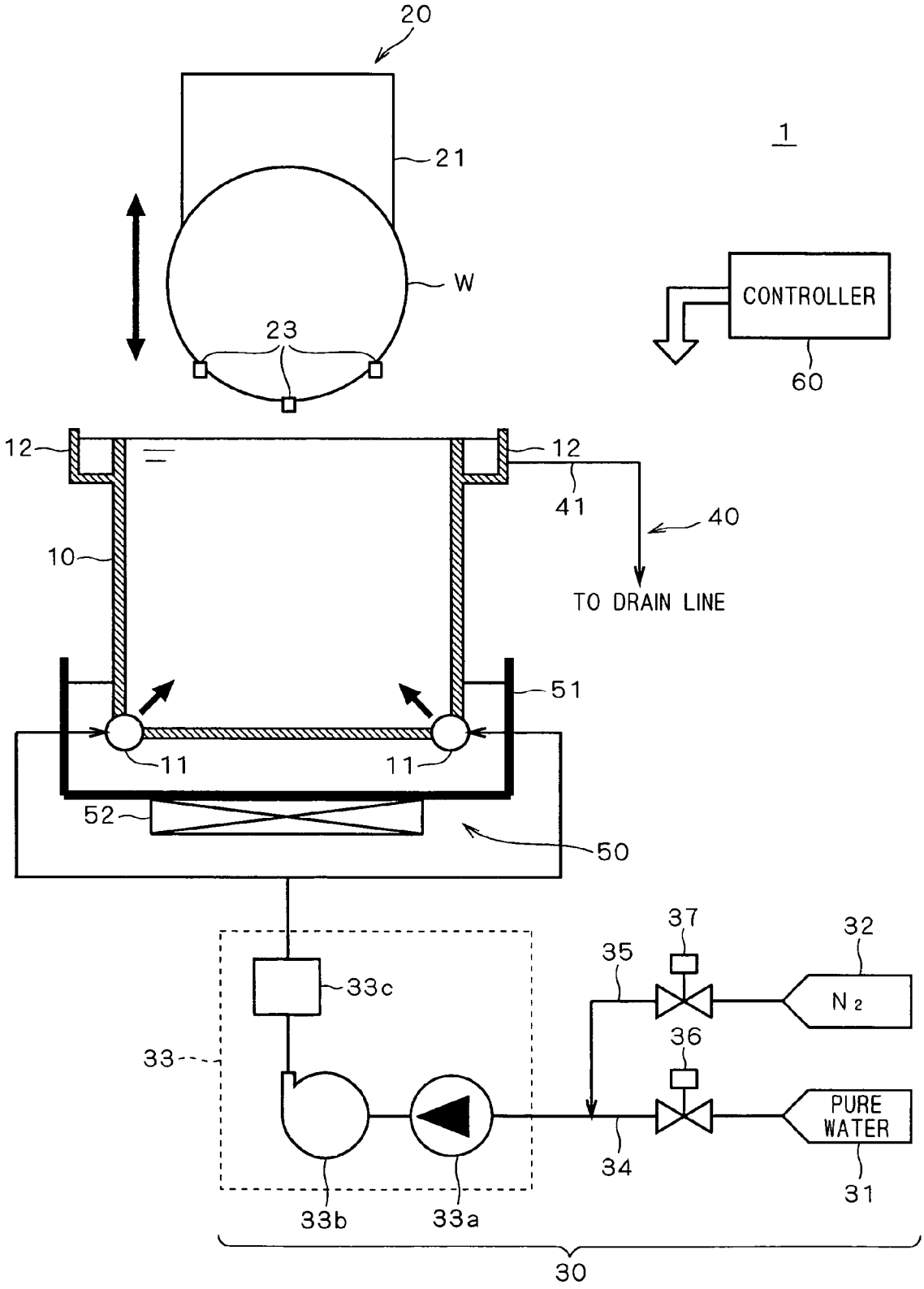
FIG. 1 is a longitudinal cross-sectional view of a substrate processing apparatus taken along a plane parallel to a substrate, according to a first preferred embodiment.
Figure 2:
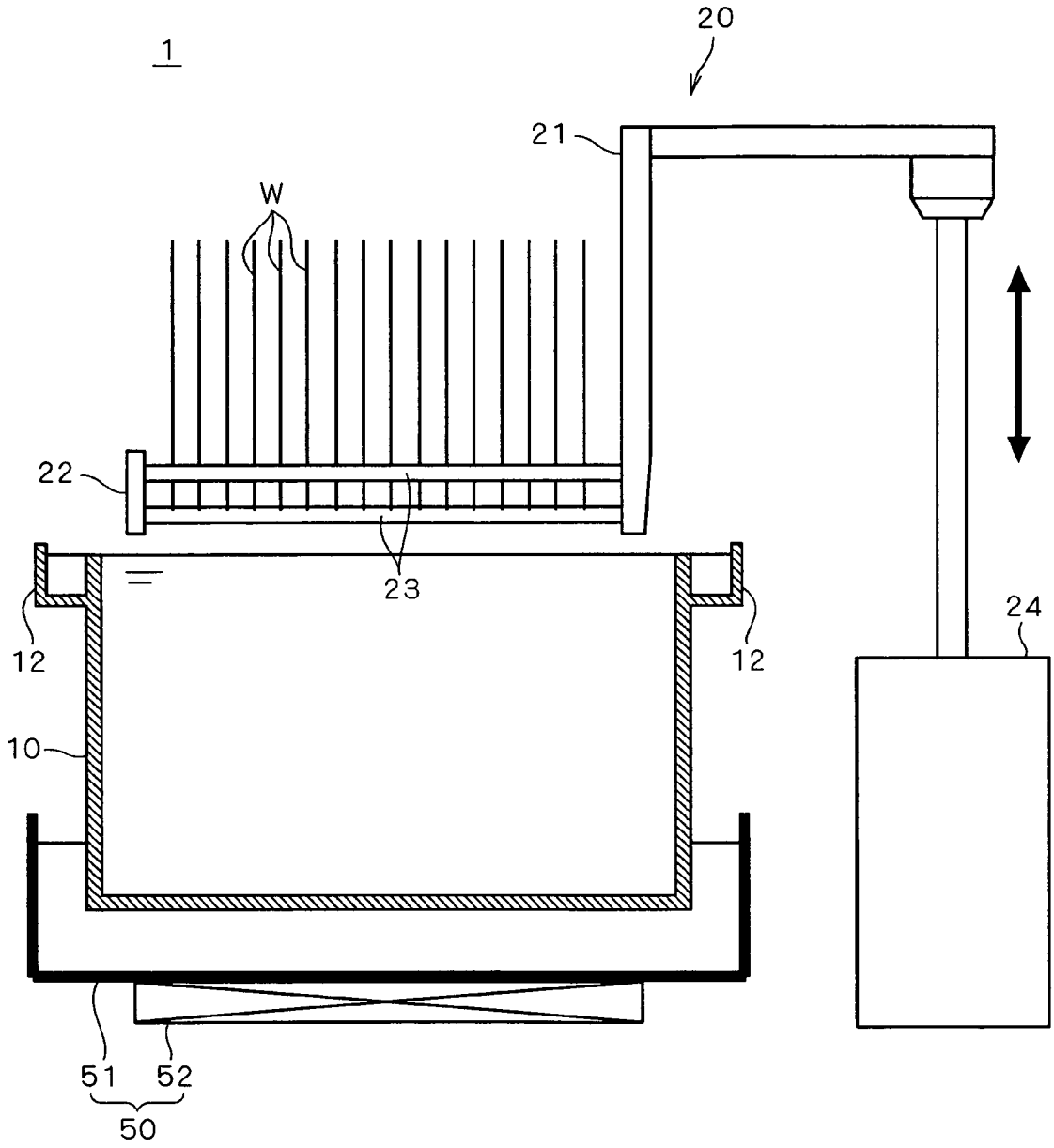
FIG. 2 is a longitudinal cross-sectional view of the substrate processing apparatus taken along a plane perpendicular to the substrate, according to the first preferred embodiment.

First, a first preferred embodiment of the present invention will be described. The first preferred embodiment has described the application of the present invention to a batch substrate processing apparatus. FIG. 1 is a longitudinal cross-sectional view of a substrate processing apparatus 1 taken along a plane parallel to substrates W, according to the first preferred embodiment. FIG. 1 also shows piping and the structure of a control system. FIG. 2 is a longitudinal cross-sectional view of the substrate processing apparatus 1 taken along a plane perpendicular to the substrates W.

As shown in FIGS. 1 and 2, the substrate processing apparatus 1 mainly includes a processing bath 10, a lifter 20, a pure-water supply system 30, a drainage system 40, an ultrasonic generator 50, and a controller 60.

The processing bath 10 is a reservoir for retaining pure water as a processing liquid. The substrate processing apparatus 1 immerses the substrates W in pure water retained in the processing bath 10 to perform processing such as cleaning on the substrates W. The processing bath 10 has discharge ports 11 at the bottom. The discharge ports 11 discharge pure water into the processing bath 10 as shown by arrows in FIG. 1. The upper surface of the processing bath 10 is opened, and the top edge of its outer surface is provided with an external bath 12. Pure water discharged from the discharge ports 11 flows upward within the processing bath 10 and then overflows from the upper opening to the external bath 12.

The lifter 20 has three holding bars 23 between a lifter head 21 and a holding plate 22. The holding bars 23 each have a plurality of holding grooves (not shown) engraved thereon. A plurality of substrates W are held in upright positions on the holding grooves. The lifter 20 is connected to a lifter drive 24 having a servo motor, a timing belt, and the like. The lifter 20 moves up and down by operation of the lifter drive 24. Thereby, the plurality of substrates W move between their immersed positions in the processing bath 10 and their pulled-up positions above the processing bath 10. When processing the substrates W using pure water, the substrate processing apparatus 1 moves the lifter 20 down to immerse the substrates W into the processing bath 10. When not processing the substrates W, the substrate processing apparatus 1 moves the lifter 20 up to pull up the substrates W above the processing bath 10.

The pure-water supply system 30 is a pipeline for supplying pure water to the discharge ports 11. The pure-water supply system 30 includes a pure-water supply source 31, a nitrogen-gas supply source 32, a microbubble generator 33, pipes 34 and 35, and on-off valves 36 and 37. The pipe 34 extends from the pure-water supply source 31, and the on-off valve 36 is interposed in the pipe 34. The pipe 35 extends from the nitrogen-gas supply source 32, and the on-off valve 37 is interposed in the pipe 35. The pipe 35 joins the pipe 34 downstream of the on-off valve 37. The joined pipe 34 is connected to the discharge ports 11 via the microbubble generator 33. The microbubble generator 33 is a device for generating minute air bubbles of micrometer order, i.e., microbubbles. The microbubble generator 33 includes a gas-liquid mixer pump 33*a*, a spin accelerator 33*b*, and a disperser 33*c* on the pipe 34.

In this configuration, opening the on-off valves 36 and 37 introduces pure water and nitrogen gas into the gas-liquid mixer pump 33*a*. The pure water and the nitrogen gas are mixed together in the gas-liquid mixer pump 33*a* and transmitted to the spin accelerator 33*b*. The spin accelerator 33*b* accelerates and spins the pure water and the nitrogen gas, forming two-phase gas-liquid flow, and delivers the flow to the disperser 33*c*. The disperser 33*c* shears the delivered two-phase gas-liquid flow to form microbubbles of nitrogen gas. Then, the pure water containing those microbubbles are discharged from the discharge ports 11 into the processing bath 10. If only the on-off valve 36 is opened with the on-off valve 37 closed, only pure water containing no microbubbles is supplied from the discharge ports 11 to the processing bath 10.

The gas-liquid mixer pump 33*a*, the spin accelerator 33*b*, and the disperser 33*c* described above vigorously mix nitrogen gas with pure water in generating microbubbles. Thus, part of nitrogen gas supplied from the nitrogen-gas supply source 32 dissolves in pure water. That is, the microbubble generator 33 also has the function of dissolving nitrogen gas in pure water.

The drainage system 40 has a pipe 41 that connects the external bath 12 and a drain line in a facility. Pure water overflowing from the processing bath 10 to the external bath 12 is drained to the drain line through the pipe 41.

The ultrasonic generator 50 includes a propagation bath 51 provided under the processing bath 10, and an ultrasonic vibrator 52 provided at the back of the bottom surface of the propagation bath 51. The propagation bath 51 retains a propagation liquid for propagating ultrasonic vibrations. Operating the ultrasonic vibrator 52 generates ultrasonic vibrations. The ultrasonic vibrations causes vibration of the bottom of the propagation bath 51, the propagation liquid, the bottom of the processing bath 10, and pure water in the processing bath 10 in sequence, and then are propagated to the surfaces of the substrates W.

The controller 60 is electrically connected to the lifter drive 24, the microbubble generator 33, the on-off valves 36 and 37, the ultrasonic vibrator 52, and the like, for control of their operations.

Next, the operation of the substrate processing apparatus 1 with the aforementioned configuration will be described below. FIGS. 3 to 6 show the operation of the substrate processing apparatus 1 at each stage. Those operations proceed by controlling the lifter drive 24, the microbubble generator 33, the on-off valves 36 and 37, the ultrasonic vibrator 52, and the like by the controller 60.

Figure 3:
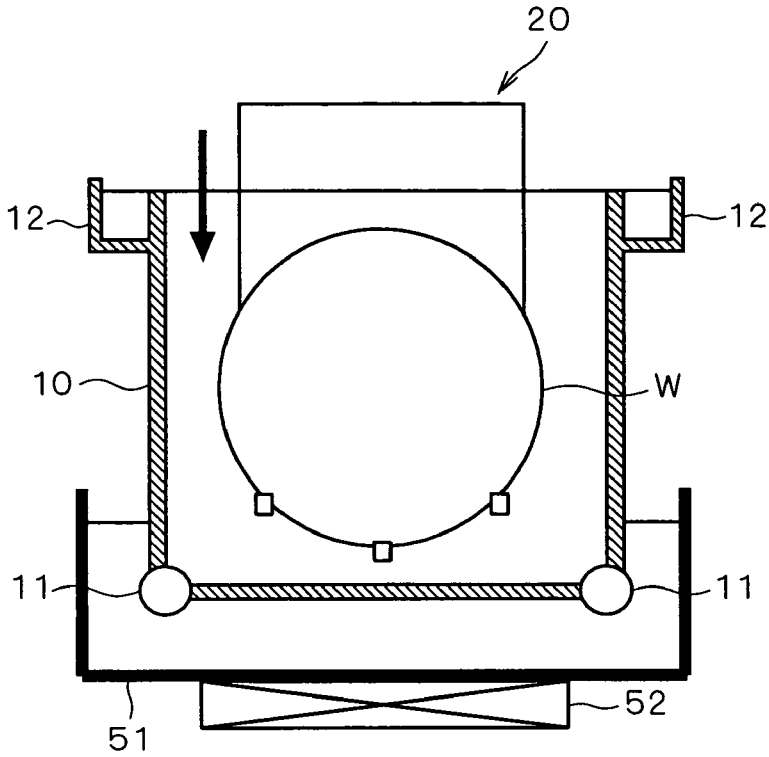
FIGS. 3 to 6 show the operation of the substrate processing apparatus according to the first preferred embodiment.

First, as shown in FIG. 3, the lifter 20 is moved down to immerse the plurality of substrates W in pure water previously retained in the processing bath 10. Alternatively, the lifter 20 may firstly be moved down, and then the on-off valve 36 (cf. FIG. 1) may be opened to fill the processing bath 10 with pure water.

Figure 4:
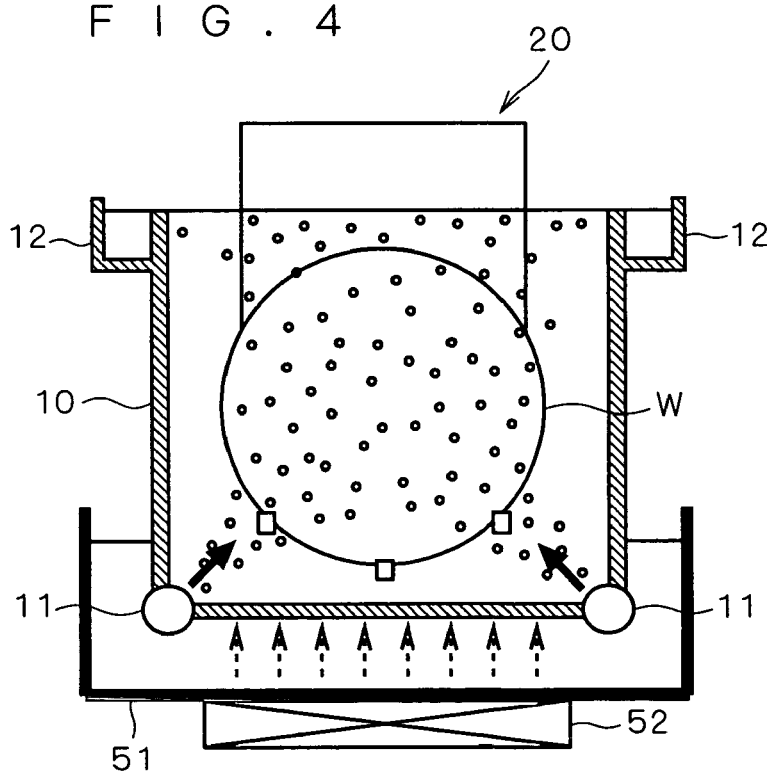

Then, as shown in FIG. 4, ultrasonic vibrations are applied and microbubbles are supplied. The ultrasonic vibrations are generated by operating the ultrasonic vibrator 52. As indicated by broken arrows in FIG. 4, the ultrasonic vibrations are propagated toward the processing bath 10 using the propagation liquid in the propagation bath 51 as a medium. In the processing bath 10, the ultrasonic vibrations are propagated through pure water to the surfaces of the substrates W. On the other hand, the microbubbles are generated by opening the on-off valves 36 and 37 (cf. FIG. 1) and operating the microbubble generator 33 (cf. FIG. 1). The microbubbles are discharged together with pure water from the discharge ports 11, rise toward the top of the processing bath 10 around the substrates W, and then overflow together with pure water to the external bath 12.

At this time, particles attached on the substrates W are liberated from the surfaces of the substrates W under the impact of the ultrasonic vibrations. Further, the processing bath 10 has formed therein a flow of pure water toward the top of the processing bath 10, in which flow microbubbles rise toward the top of the processing bath 10. Thus, the particles liberated from the surfaces of the substrates W are adsorbed on the microbubbles and carried together with the microbubbles to the top of the processing bath 10. Since microbubbles are very minute in size, they as a whole have a large surface area (the area of the bubble interface). Hence, microbubbles can efficiently adsorb particles liberated from the substrates W. Besides, since microbubbles have the electrostatic property, they can attract particles also by electrostatic action and thus can efficiently adsorb particles. The microbubbles adsorbing particles overflow together with pure water from the top of the processing bath 10 to the external bath 12 and are discharged through the pipe 41 (cf. FIG. 1) to the drain line.

Figure 5:
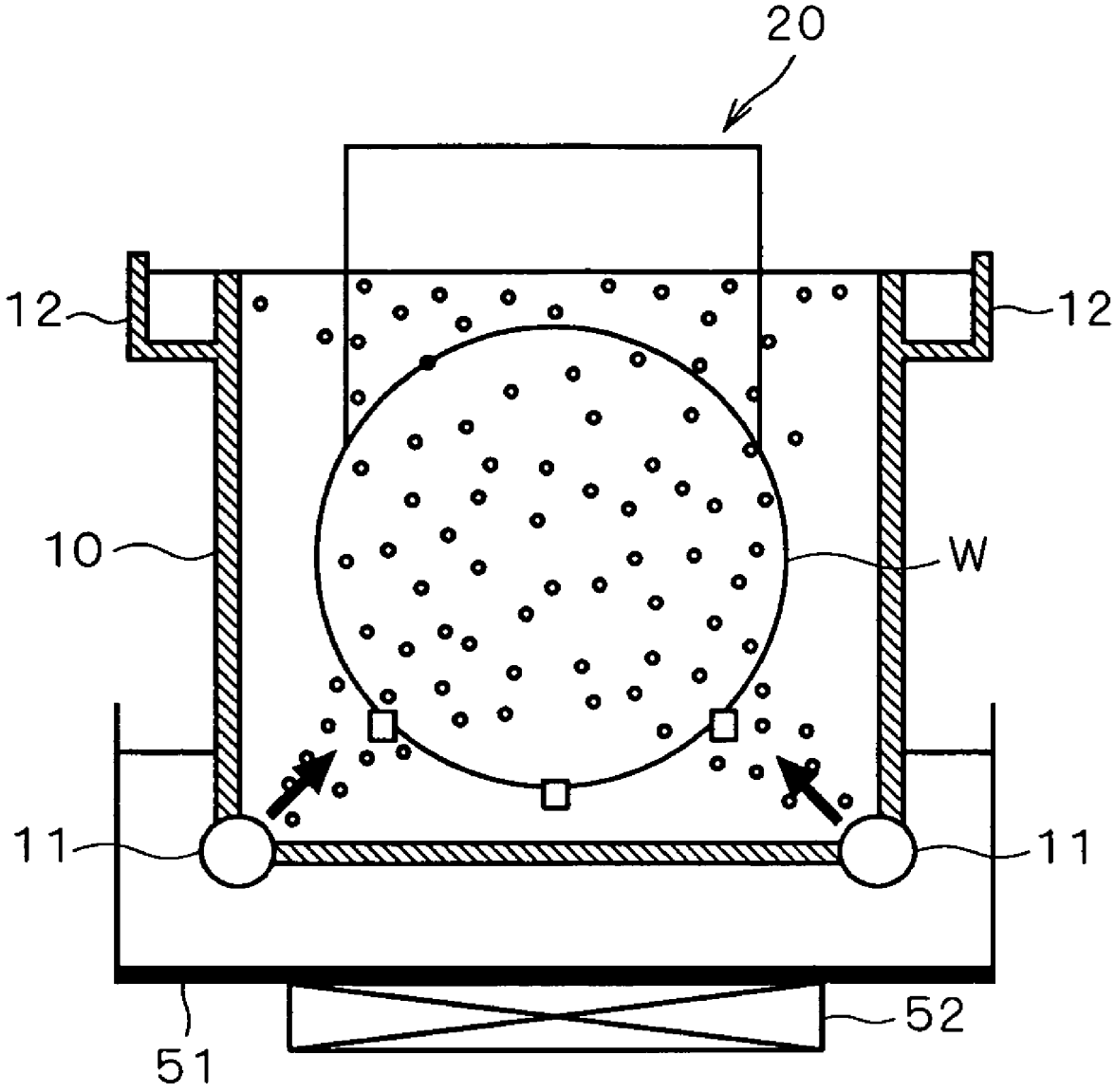

After a predetermined duration of the application of ultrasonic vibrations and the supply of microbubbles, the substrate processing apparatus 1 stops the operation of the ultrasonic vibrator 52. Then, as shown in FIG. 5, the substrate processing apparatus 1 continues only the supply of microbubbles. Particles remaining in the pure water are adsorbed on the microbubbles and removed out of the processing bath 10. This prevents particles remaining in the processing bath 10 to reattach on the substrates W.

Figure 6:
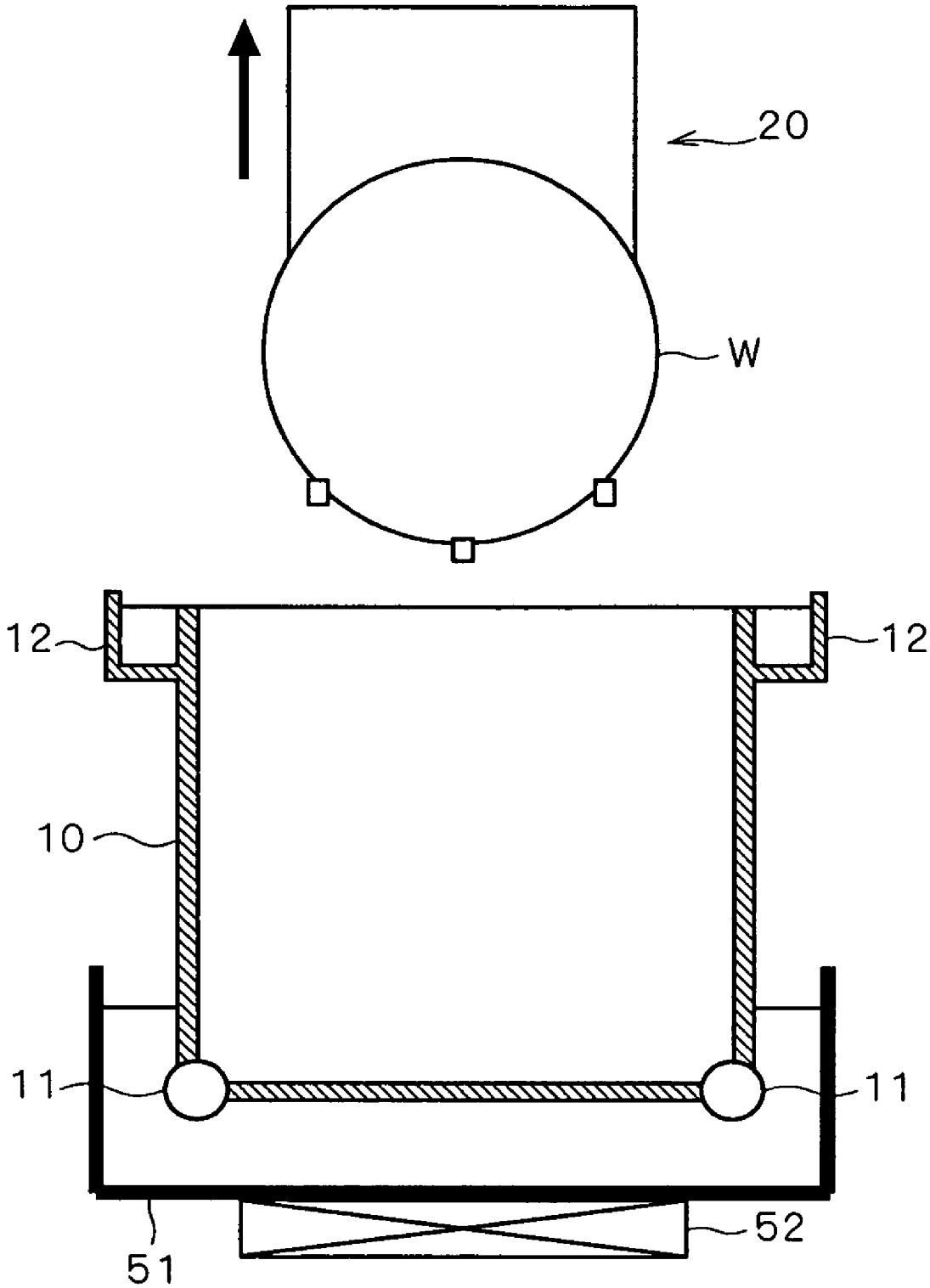

Then, the substrate processing apparatus 1 moves the lifter 20 up to lift the substrates W out of the processing bath 10 as shown in FIG. 6. This completes the processing of the substrate processing apparatus 1 performed on the substrates W. With the substrates W lifted above the processing bath 10 or after transport of the substrates W to other devices, the substrates W are subjected to drying.

As so far described, this substrate processing apparatus 1 liberates particles from the substrates W under the impact of the ultrasonic vibrations and causes the liberated particles to be adsorbed on microbubbles to carry them out. This allows efficient particle removal. Further, this substrate processing apparatus 1 applies ultrasonic vibrations while supplying microbubbles around the substrates W. Thus, the impact of the ultrasonic vibrations is absorbed in the microbubbles, which relieves the excessive impact on the substrates W. That is, this substrate processing apparatus 1 can liberate particles from the substrates W while reducing the damage on the substrates W.

Further in the microbubble generator 33, part of the nitrogen gas dissolves in the pure water. Thus, the pure water supplied around the substrates W contains dissolved nitrogen gas. Since pure water (especially ultrapure water) has high insulation property, it may become electrostatically charged by friction with an inner wall of pipes or the like. However, dissolving nitrogen gas in pure water inhibits such electrostatic charging of the pure water. Accordingly, it can be prevented that the pure water itself adsorbs particles from each component such as the pipes or the processing bath 10 by its elecrostatic effect and thereby increases the number of particles contained therein. This prevents attachment of new particles on the substrates W and improves the efficiency of particle removal.

Further, pure water dissolving nitrogen gas has the characteristic of propagating ultrasonic vibrations with greater efficiency than vacuum pure water. Accordingly, the ultrasonic vibrations can reach the surfaces of the substrates W with greater efficiency, which improves the efficiency of particle liberation from the surfaces of the substrates W.

2. Second Preferred Embodiment

Figure 7:
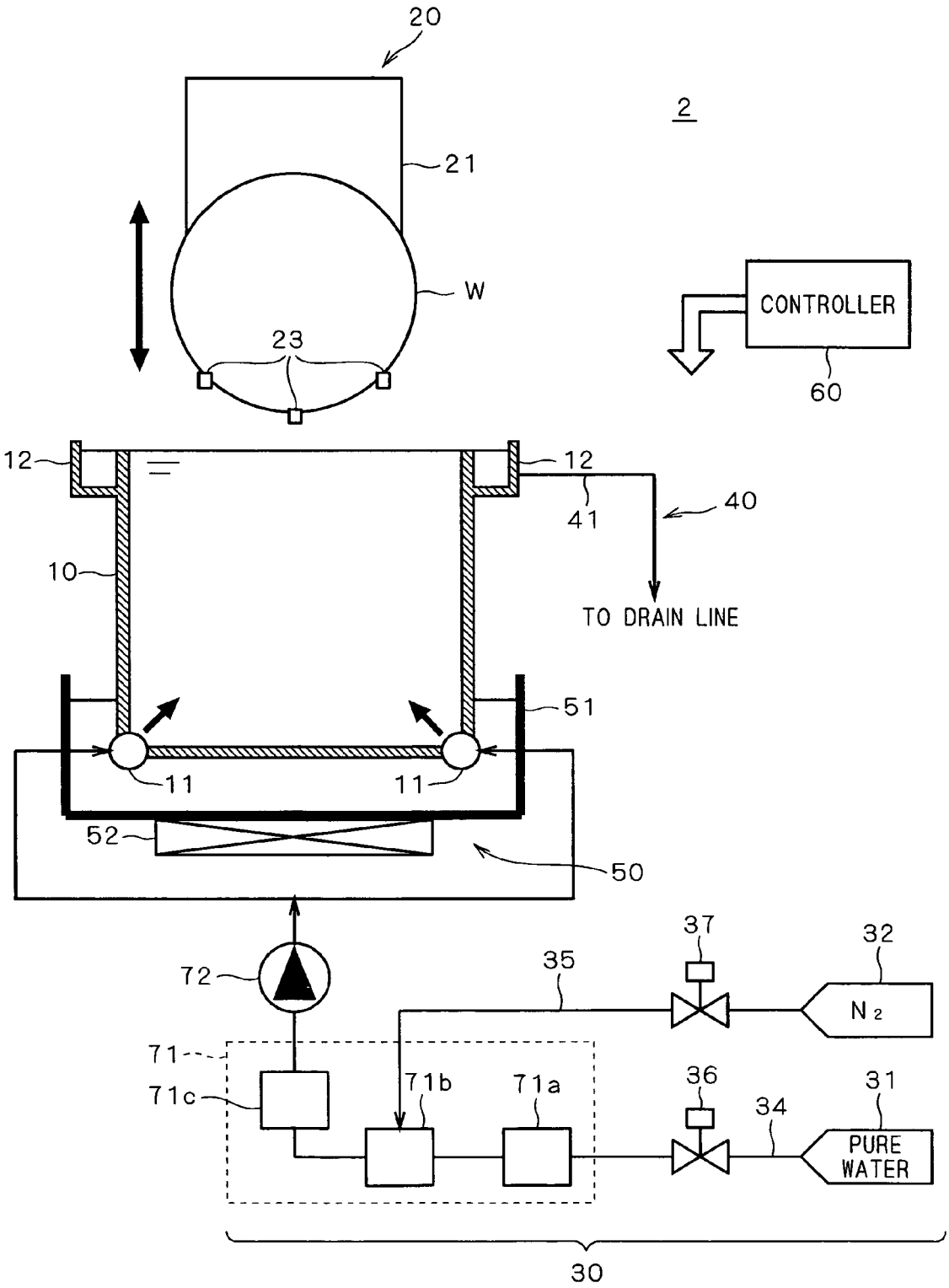
FIG. 7 is a longitudinal cross-sectional view of a substrate processing apparatus taken along a plane parallel to a substrate, according to a second preferred embodiment.

Next, a second preferred embodiment of the present invention will be described. The second preferred embodiment also has described the application of the present invention to a batch substrate processing apparatus. FIG. 7 is a longitudinal cross-sectional view of a substrate processing apparatus 2 taken along a plane parallel to the substrates W, according to the second preferred embodiment. This substrate processing apparatus 2 differs from the aforementioned substrate processing apparatus 1 in the structures of a microbubble generator 71 and a pump 72, but is identical in the other components. Thus, the components other than the microbubble generator 71 and the pump 72 in FIG. 7 are designated by the same reference numerals or characters as used in FIG. 1 and will not be described to avoid redundancy. A longitudinal cross-sectional view of the substrate processing apparatus 2 taken along a plane perpendicular to the substrates W is identical to FIG. 2.

The microbubble generator 71 in the substrate processing apparatus 2 includes a deaerator 71*a*, a gas dissolver 71*b*, and a heater 71*c* on the pipe 34. The deaerator 71*a*, the gas dissolver 71*b*, and the heater 71*c* are electrically connected to the controller 60. Further, the gas dissolver 71*b* is connected to the nitrogen-gas supply source 32 through the pipe 35.

In this configuration, opening the on-off valve 36 and operating the pump 72 introduce pure water from the pure-water supply source 31 into the deaerator 71*a*. The deaerator 71*a* removes excessive gas dissolved in the pure water by reducing pressure or the like and transmits deaired pure water to the gas dissolver 71*b*. On the other hand, opening the on-off valve 37 introduces nitrogen gas from the nitrogen-gas supply source 32 into the gas dissolver 71*b*. The gas dissolver 71*b* dissolves the introduced nitrogen gas in the pure water by the application of pressure.

Figure 8:
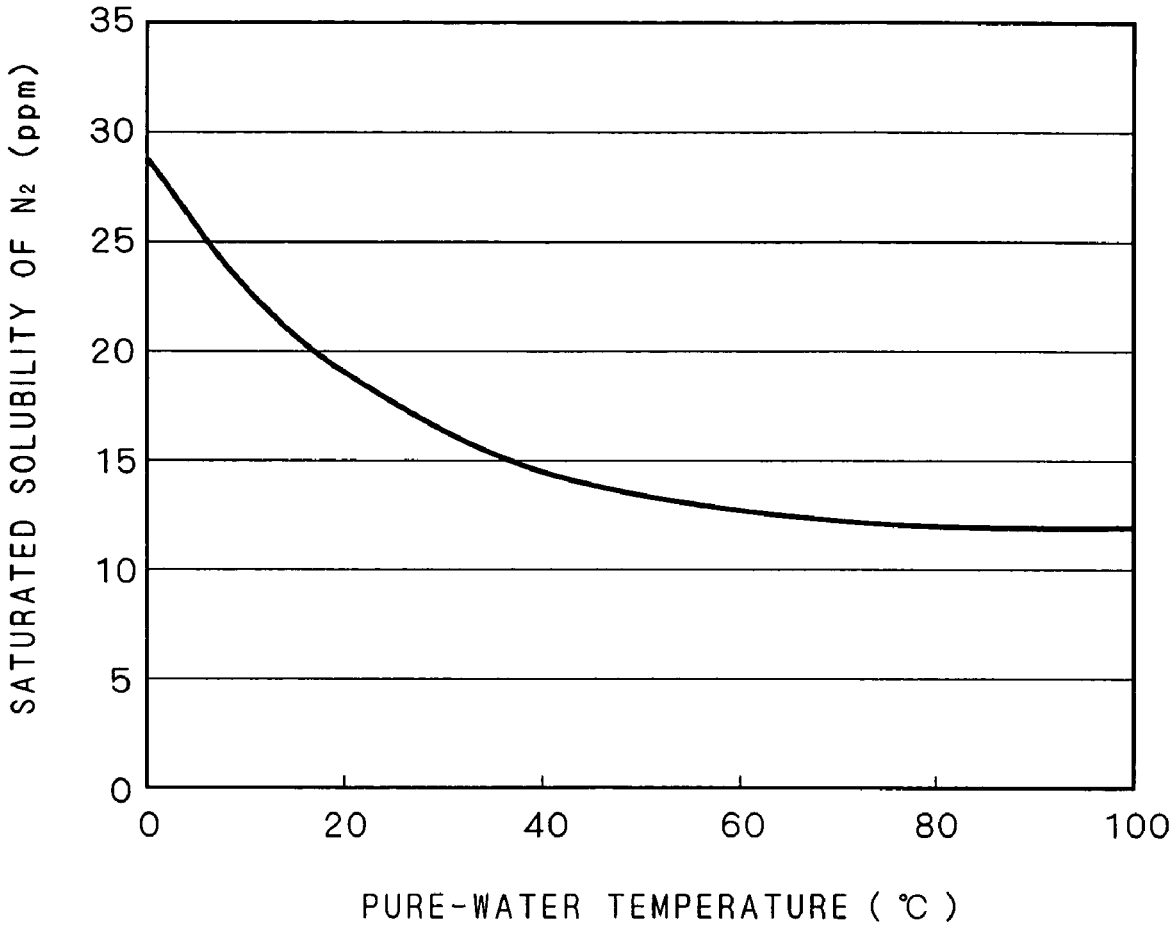
FIG. 8 is a graph showing the saturated solubility of nitrogen gas in pure water.

The inside of the gas dissolver 71 is kept at high pressure in order to dissolve nitrogen gas in pure water by the application of pressure. When the pure water dissolving nitrogen gas comes out of the gas dissolver 71*b*, pressure around the pure water is reduced to normal atmospheric pressure. From this, if in the gas dissolver 71*b* under high pressure, the solubility of nitrogen gas dissolved in the pure water exceeds the saturated solubility under normal atmospheric pressure, the pure water when coming out of the gas dissolver 71*b* becomes supersaturated with reduction of pressure, and nitrogen gas that cannot remain dissolved in the pure water appears as small microbubbles. FIG. 8 shows the saturated solubility of nitrogen gas in pure water under normal atmospheric pressure. If the gas dissolver 71*b* dissolves nitrogen gas by the application of pressure in such a manner that the concentration of nitrogen gas in pure water becomes greater than the saturated solubility in FIG. 8, the reduction of pressure when the pure water comes out of the gas dissolver 71*b* produces microbubbles. The amount of microbubbles generated here is controlled by the pressure value at the gas dissolver 71*b* and the amount of nitrogen gas supply.

The pure water coming out of the gas dissolver 71*b* contains dissolved nitrogen gas and microbubbles generated from part of the nitrogen gas, and is introduced into the heater 71*c*. The heater 71*c* heats the introduced pure water. As shown in FIG. 8, the saturated solubility of nitrogen gas decreases with increasing temperature. Thus, the pure water dissolving nitrogen gas again becomes supersaturated with increase of temperature, and nitrogen gas that cannot remain dissolved in the pure water appears as microbubbles. The amount of microbubbles generated here is controlled by the set temperature of the heater 71*c*.

As so far described, the microbubble generator 71 according to this preferred embodiment achieves a first supersaturated condition with reduction of pressure when the pure water comes out of the gas dissolver 71*b* thereby to generate first microbubbles. The microbubble generator 71 then achieves a second supersaturated condition with increase of temperature of the pure water passing through the heater 71 thereby to generate second microbubbles. Those first and second microbubbles may be generated both, or only either of them may be generated. For example, in the case where the pure water should not be heated, only the first microbubbles are generated without operating the heater 71*c*.

Figure 9:
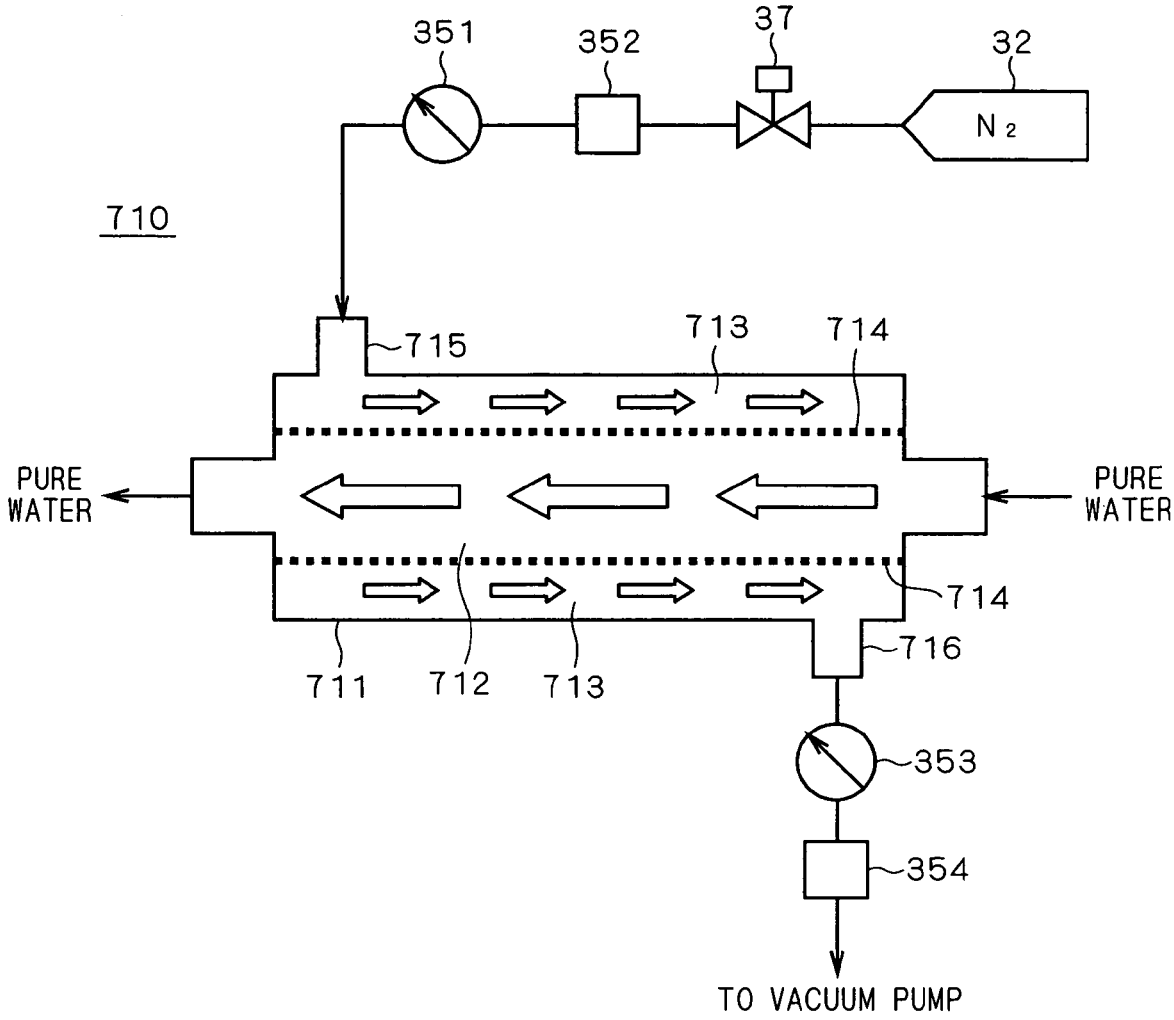
FIG. 9 shows a unit usable as a deaerator or a gas dissolver.

FIG. 7 schematically shows the components of the microbubble generator 71, namely the deaerator 71*a* and the gas dissolver 71*b*, in a block diagram. The deaerator 71*a* and the gas dissolver 71*b*, in a concrete form, can be implemented with a unit 710 as shown in FIG. 9. The unit 710 in FIG. 9 is configured such that a generally cylindrical-shaped casing 711 has formed therein a water pipe 712 passing through the axis of the casing 711 and a gas supply line 713 surrounding the water pipe 712. Inside the water pipe 712 and the gas supply line 713, pure water and nitrogen gas, respectively, flow in directions indicated by arrows in the figure. The water pipe 712 and the gas supply line 713 are partitioned with a hollow fiber type separation film 714 having gas permeability and liquid impermeability. A gas inlet 715 of the unit 710 is connected to the nitrogen-gas supply source 32 via a pressure gage 351, a regulator 352, and the on-off valve 37, and a gas outlet 716 of the unit 710 is connected to a vacuum pump via a pressure gage 353 and a regulator 354. The pressure gages 351 and 353 and the regulators 352 and 354 are electrically connected to the aforementioned controller 60.

Such a unit 710 can control the pressure of nitrogen gas flowing through the gas supply line 713, i.e., can increase or decrease pressure in the casing 711, by opening the on-off valve 37 and controlling the regulators 352 and 354 based on the outputs of the pressure gages 351 and 353. If pressure in the casing 711 is reduced, a redundant gas is separated out of the pure water flowing through the water pipe 712 due to supersaturation and flows out to the gas supply line 713 through the hollow fiber type separation film 714. On the other hand, when pressure in the casing 711 is increased, nitrogen gas flowing through the gas supply line 713 is pressure-dissolved in the pure water in the water pipe 712 through the hollow fiber type separation film 714.

That is, this unit 710 can be used as the aforementioned deaerator 71*a* when pressure in the casing 711 is reduced, and can be used as the aforementioned gas dissolver 71*b* when pressure in the casing 711 is increased.

This substrate processing apparatus 2, as above described, differs from the apparatus of the first preferred embodiment in the structure of the microbubble generator 71, but it operates in the same manner as described in the first preferred embodiment and as shown in FIGS. 3 to 6. That is, after the substrates W are immersed in pure water in the processing bath 10, ultrasonic vibrations are applied and microbubbles are supplied.

Therefore, this substrate processing apparatus 2 can also liberate particles from the substrates W under the impact of the ultrasonic vibrations and cause the liberated particles to be adsorbed on microbubbles to be removed. Besides, the microbubbles can relieve the excessive impact of the ultrasonic vibrations.

Further also in this substrate processing apparatus 2, part of nitrogen gas dissolved in the pure water by the gas dissolver 71*b* remains dissolved in the pure water without appearing as microbubbles. Thus, the effects of inhibiting charging of the pure water itself and improving the efficiency of propagation of the ultrasonic vibrations can be achieved as in the first preferred embodiment.

Figure 10:
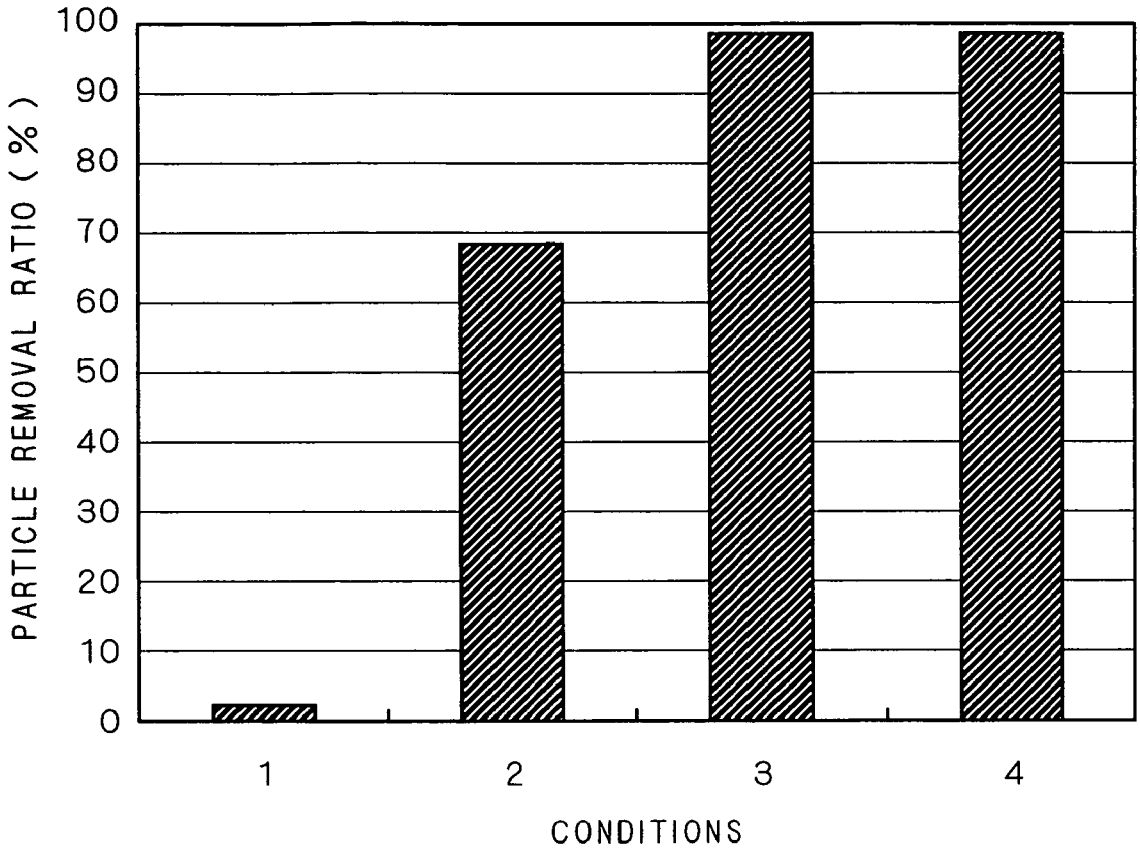
FIG. 10 is a graph showing a removal ratio of particles from a substrate.

Now, actual processing is performed for a predetermined time in this substrate processing apparatus 2 to measure a removal ratio of particles from the substrates W before and after the processing. The results obtained are shown in FIG. 10. First to fourth conditions numbered 1 to 4 in FIG. 10 are as follows. The first condition is that nitrogen gas is not supplied in pure water, and the pure water is not heated by the heater 71. The second condition is that the solubility of nitrogen gas is set at 17.1 ppm in the gas dissolver 71*b*, and pure water is not heated by the heater 71*c*. In the second condition, no microbubbles are generated since the solubility of nitrogen gas does not reach the saturated solubility. The third condition is that the solubility of nitrogen gas is set at 20.0 ppm in the gas dissolver 71*b*, and pure water is heated to 41° C. by the heater 71*c*. In the third condition, part of dissolved nitrogen gas appears as microbubbles due to supersaturation. The fourth condition is that the solubility of nitrogen gas is set at 23.0 ppm in the gas dissolver 71*b*, and pure water is not heated by the heater 71*c*. Also in the fourth condition, part of dissolved nitrogen gas appears as microbubbles due to supersaturation. In either of the first to fourth conditions, the ultrasonic vibrator 52 is in operation.

The comparison of the results obtained in the first and second conditions shows that dissolving nitrogen gas in pure water has dramatically improved the efficiency of particle removal. Further, the comparison of the results obtained in the second condition and the third and fourth conditions shows that the generation of microbubbles has further improved the efficiency of particle removal.

3. Third Preferred Embodiment

Figure 11:
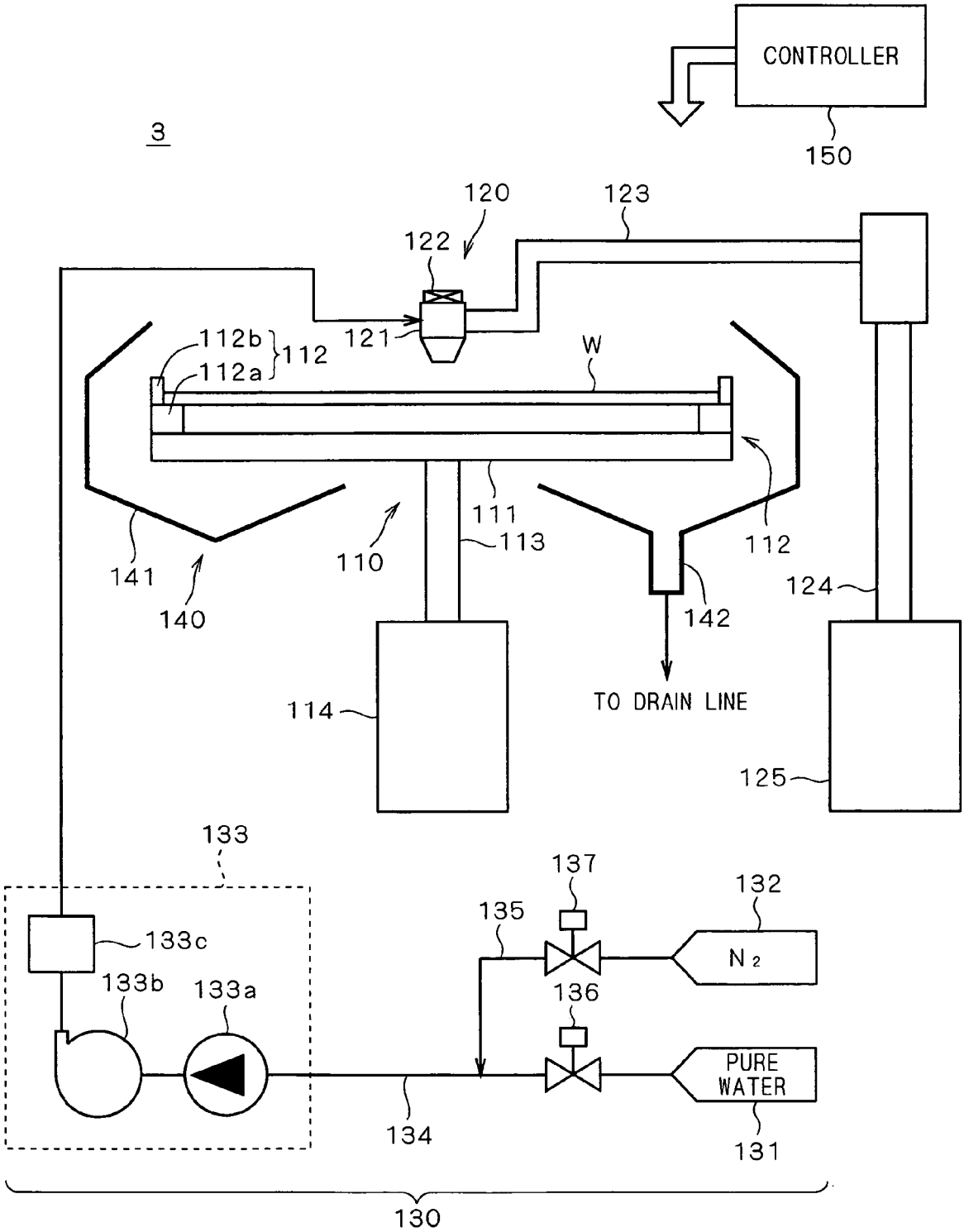
FIG. 11 is a longitudinal cross-sectional view of a substrate processing apparatus according to a third preferred embodiment.

Next, a third preferred embodiment of the present invention will be described. The third preferred embodiment has described the application of the present invention to a single-substrate processing apparatus. FIG. 11 is a longitudinal cross-sectional view of a substrate processing apparatus 3 according to the third preferred embodiment. FIG. 11 also shows piping and the structure of a control system.

As shown in FIG. 11, the substrate processing apparatus 3 mainly includes a substrate holder 110, a pure-water discharge unit 120, a pure-water supply system 130, a pure-water recovery unit 140, and a controller 150.

The substrate holder 110 has a disc-shaped base material 111 and a plurality of chuck pins 112 provided upright on the surface of the base material 111. There are three or more chuck pins 112 provided along the peripheral edge of the base material 111 to hold a circular substrate W. The substrate W is placed on substrate supporting parts 112*a* of the plurality of chuck pins 112 and is held with its outer edge being pressed against chucks 112*b*. A rotary shaft 113 is provided perpendicularly at the center on the underside of the base material 111. The lower end of the rotary shaft 113 is coupled to an electric motor 114. Driving the electric motor 114 integrally rotates the rotary shaft 113, the base material 111, and the substrate W held on the base material 111.

The pure-water discharge unit 120 has a nozzle 121 for discharging pure water on the upper surface of the substrate W. The nozzle 121 has an ultrasonic vibrator 122 attached to its top. Operating the ultrasonic vibrator 122 applies ultrasonic vibrations to pure water in the nozzle 121. The nozzle 121 is connected through a link member 123 to a rotary shaft 124 whose lower end is coupled to an electric motor 125. Thus, driving the electric motor 125 integrally rotates the rotary shaft 124, the link member 123, and the nozzle 121. The nozzle 121 discharges pure water to each part of the substrate W extending from the center to the peripheral edge.

The pure-water supply system 130 is a pipeline for supplying pure water to the pure-water discharge unit 120. The pure-water supply system 130 includes a pure-water supply source 131, a nitrogen-gas supply source 132, a microbubble generator 133, pipes 134 and 135, and on-off valves 136 and 137. The pipe 134 extends from the pure-water supply source 131, and the on-off valve 136 is interposed in the pipe 134. The pipe 135 extends from the nitrogen-gas supply source 132, and the on-off valve 137 is interposed in the pipe 135. The pipe 135 joins the pipe 134 downstream of the on-off valve 137. The joined pipe 134 is connected to the nozzle 121 through the microbubble generator 133. The pipe 134 is made of a member having flexibility at least in the vicinity of the nozzle 121 and is configured to be capable of following the rotation of the nozzle 121.

The microbubble generator 133 is a device for generating minute air bubbles of micrometer order, i.e., microbubbles. The microbubble generator 133 is identical in structure to the microbubble generator 33 of the first preferred embodiment and includes a gas-liquid mixer pump 133*a*, a spin accelerator 133*b*, and a disperser 133*c* on the pipe 134.

In this configuration, opening the on-off valves 136 and 137 introduces pure water and nitrogen gas into the gas-liquid mixer pump 133*a*. The pure water and the nitrogen gas are mixed together in the gas-liquid mixer pump 133*a* and transmitted to the spin accelerator 133*b*. The spin accelerator 133*b* accelerates and spins the pure water and the nitrogen gas, thereby forming two-phase gas-liquid flow, and delivers the flow to the disperser 133*c*. The disperser 133*c* shears the delivered two-phase gas-liquid flow to form microbubbles of nitrogen gas. Then, the pure water containing those microbubbles is discharged from the nozzle 121 on the upper surface of the substrate W. If only the on-off valve 136 is opened with the on-off valve 137 closed, only pure water containing no microbubbles is supplied to the upper surface of the substrate W.

The gas-liquid mixer pump 133*a*, the spin accelerator 133*b*, and the disperser 133*c* described above vigorously mix nitrogen gas with pure water in generating microbubbles. Thus, part of nitrogen gas supplied from the nitrogen-gas supply source 132 dissolves in pure water. That is, the microbubble generator 133 also has the function of dissolving nitrogen gas in pure water.

The pure-water recovery unit 140 includes a guard member 141 which surrounds the periphery of the substrate W held on the base material 111. The guard member 141 receives pure water scattered around from the substrate W on its inner wall. The guard member 141 has a drain port 142 in part of its bottom surface. Pure water received on the guard member 141 reaches the drain port 142 along the inner wall of the guard member 141 and is drained to a drain line from the drain port 142.

The controller 150 is electrically connected to the chuck pins 112, the electric motors 114 and 125, the ultrasonic vibrator 122, the microbubble generator 133, the on-off valves 136 and 137, and the like, for control of their operations.

Figure 12:
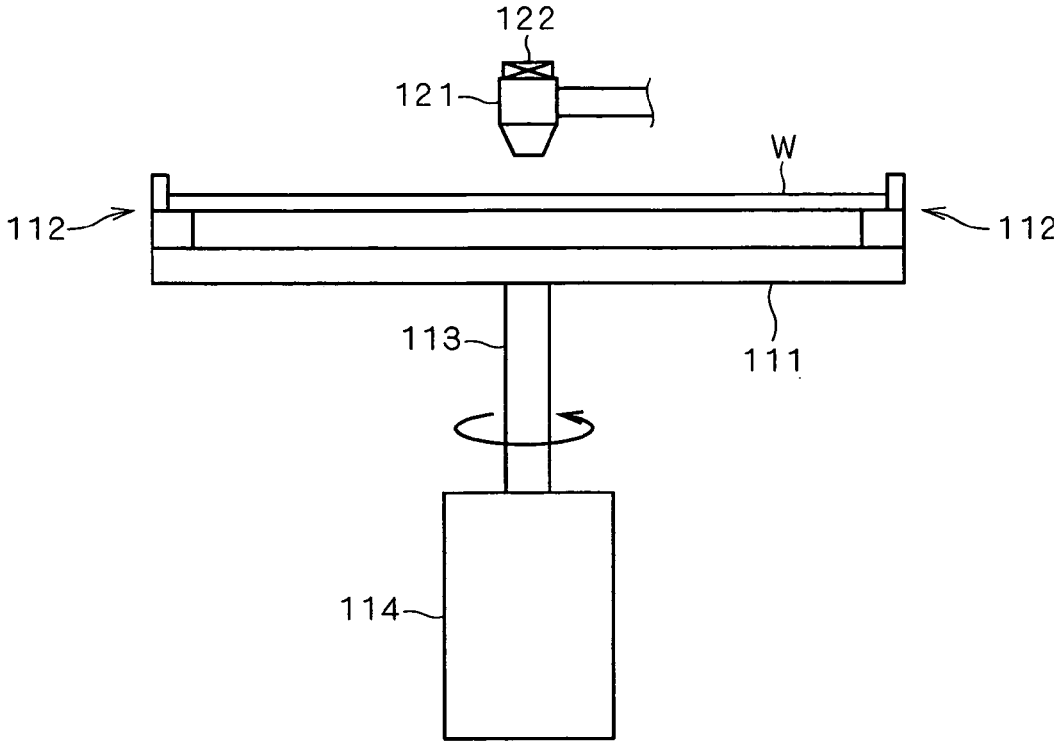
FIGS. 12 and 13 show the operation of the substrate processing apparatus according to the third preferred embodiment.
Figure 13:
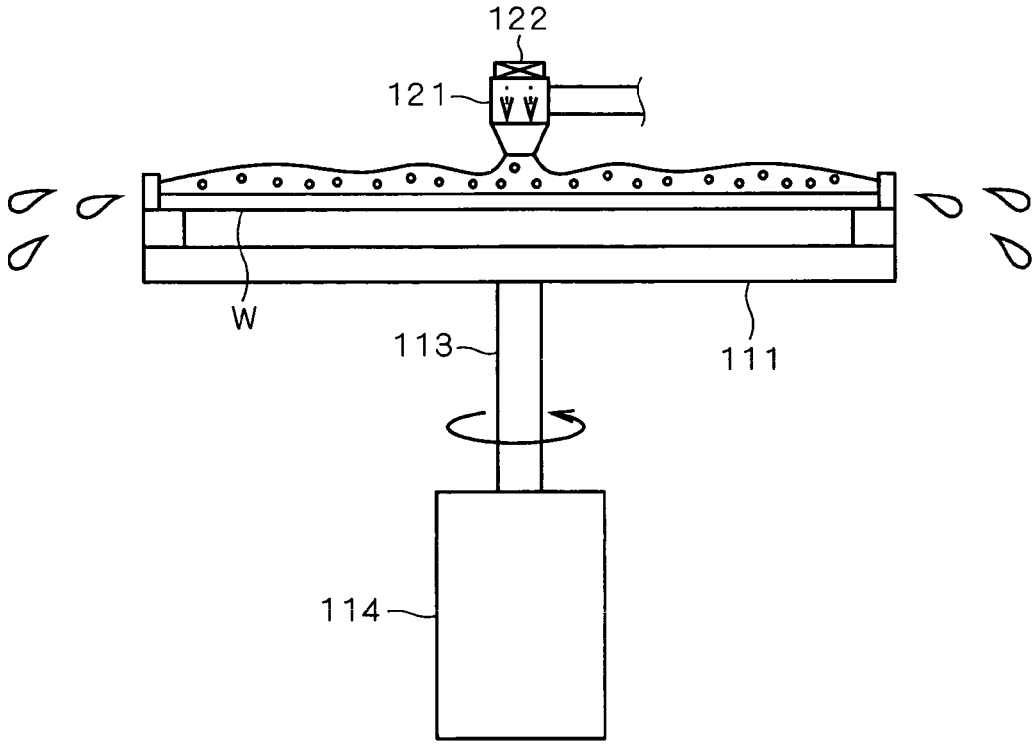

Next, the operation of the substrate processing apparatus 3 with this configuration will be described below. FIGS. 12 and 13 show the operation of the substrate processing apparatus 3 at each stage. Those operations proceed by controlling the chuck pins 112, the electric motors 114 and 125, the ultrasonic vibrator 122, the microbubble generator 133, the on-off valves 136 and 137, and the like by the controller 150.

First, as shown in FIG. 12, the substrate W is placed on the base material 111, and the chuck pins 112 grasp the substrate W. Then, the electric motor 114 is driven to rotate the substrate W with the base material 111.

Then, the on-off valves 136 and 137 (cf. FIG. 11) are opened and the microbubble generator 133 (cf. FIG. 11) is driven to discharge pure water containing microbubbles on the upper surface of the substrate W as shown in FIG. 13. Further, the ultrasonic vibrator 122 is operated to apply ultrasonic vibrations to the pure water discharged from the nozzle 121. The pure water discharged on the upper surface of the substrate W is forced to the outside by centrifugal force caused by the rotation of the substrate W and, after received by the guard member 141 (cf. FIG. 11), drained to the drain line via the drain port 142 (cf. FIG. 11).

With the discharge of the pure water on the upper surface of the substrate W, particles attached on the substrate W are liberated from the surface of the substrate W under the impact of the ultrasonic vibrations in the pure water. Further, there is formed a flow of pure water containing microbubbles toward the outside on the surface of the substrate W. From this, the particles liberated from the surface of the substrate W under the impact of the ultrasonic vibrations are adsorbed on the microbubbles and carried together with the microbubbles to the outside. Since microbubbles are very minute in size, they as a whole have a large surface area and thus can efficiently adsorb particles. Besides, since microbubbles have the electrostatic property, they can efficiently adsorb particles also by electrostatic action. In this way, particles are forced to the outside together with microbubbles and drained to the drain line through the guard member 141 (cf. FIG. 11).

After a predetermined duration of the discharge of pure water, the substrate processing apparatus 3 stops the ultrasonic vibrator 122 and the microbubble generator 133 (cf. FIG. 11) and closes the on-off valves 136 and 137 (cf. FIG. 11) to stop the discharge of pure water. Then, the number of revolutions of the electric motor 114 is increased to rotate the substrate W at high speed. Thereby, pure water remaining on the upper surface of the substrate W is forced to the outside, and accordingly the substrate W is dried. This completes the processing of the substrate processing apparatus 3 performed on the substrate W.

As so far described, this substrate processing apparatus 3 liberates particles from the substrate W under the impact of the ultrasonic vibrations and causes the liberated particles to be adsorbed on microbubbles to be removed with efficiency. Further, this substrate processing apparatus 3 applies ultrasonic vibrations while supplying microbubbles around the substrate W. Thus, the microbubbles can absorb the impact of the ultrasonic vibrations and thereby can relieve the excessive impact on the substrate W. This allows particle liberation from the substrate W while reducing the damage on the substrate W.

Further in this substrate processing apparatus 3, part of nitrogen gas dissolves in pure water in the microbubble generator 133. This inhibits charging of the pure water and prevents the pure water itself from absorbing particles from each component such as the pipes or the processing bath 10. Further, dissolving nitrogen gas in pure water allows efficient propagation of ultrasonic vibrations to the substrate W.

4. Fourth Preferred Embodiment

Figure 14:
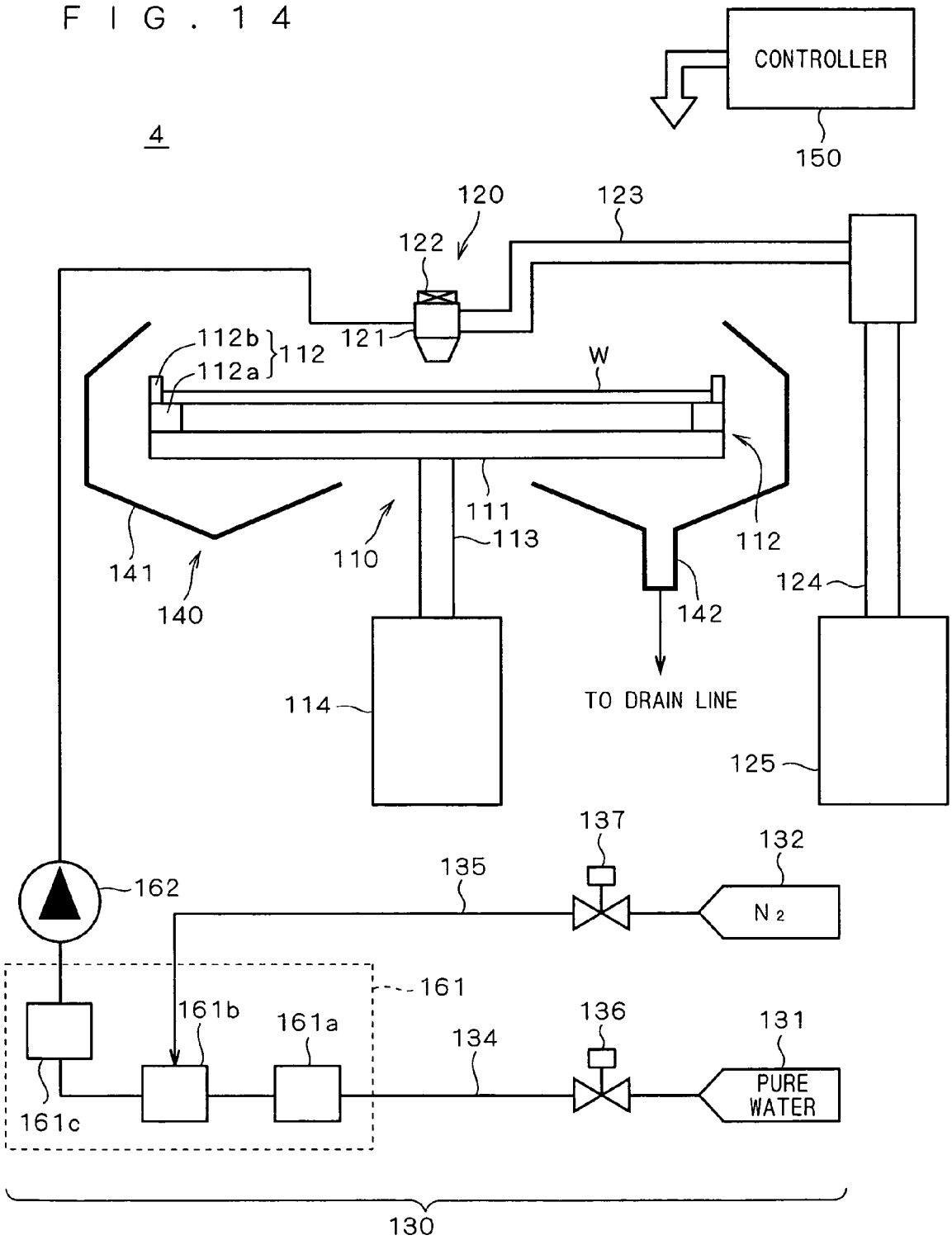
FIG. 14 is a longitudinal cross-sectional view of a substrate processing apparatus according to a fourth preferred embodiment.

Next, a fourth preferred embodiment of the present invention will be described. This fourth preferred embodiment also has described the application of the present invention to a single-substrate processing apparatus. FIG. 14 is a longitudinal cross-sectional view of a substrate processing apparatus 4 according to the fourth preferred embodiment. This substrate processing apparatus 4 differs from the aforementioned substrate processing apparatus 3 in the structures of a microbubble generator 161 and a pump 162, but is identical in the other components. Thus, the components other than the microbubble generator 161 and the pump 162 in FIG. 14 are designated by the same reference numerals or characters as used in FIG. 11 and will not be described to avoid redundancy.

The microbubble generator 161 in the substrate processing apparatus 4 is identical in structure to the microbubble generator 71 of the second preferred embodiment and includes a deaerator 161*a*, a gas dissolver 161*b*, and a heater 161*c* on the pipe 134. The deaerator 161*a*, the gas dissolver 161*b*, and the heater 161*c* are electrically connected to the aforementioned controller 150. Further, the gas dissolver 161*b* is connected to the nitrogen-gas supply source 132 through the pipe 135.

The microbubble generator 161 generates microbubbles in the same manner as the microbubble generator 71 of the second preferred embodiment. More specifically, the microbubble generator 161 achieves a first supersaturated condition with reduction of pressure when pure water comes out of the gas dissolver 161*b* thereby to generate first microbubbles. The microbubble generator 161 then achieves a second supersaturated condition with increase of temperature of the pure water passing through the heater 161*c* thereby to generate second microbubbles.

The components of the microbubble generator 161, namely the deaerator 161*a* and the gas dissolver 161*b*, can also be implemented with the unit 710 as shown in FIG. 9.

This substrate processing apparatus 4, as above described, differs from the apparatus of the third preferred embodiment in the structure of the microbubble generator 161, but it operates in the same manner as described in the third preferred embodiment and as shown in FIGS. 12 and 13. That is, pure water with microbubbles and ultrasonic vibrations is discharged on the upper surface of the substrate W that is being rotated on the base material 111.

Therefore, this substrate processing apparatus 4 can also liberate particles from the substrate W under the impact of the ultrasonic vibrations and cause the liberated particles to be adsorbed on microbubbles to be removed. Besides, the microbubbles can relieve the excessive impact of the ultrasonic vibrations on the substrate W.

Further, also in this substrate processing apparatus 4, part of the nitrogen gas dissolved in the pure water by the gas dissolver 161*b* remains dissolved in the pure water without appearing as microbubbles. Thus, the effects of inhibiting charging of the pure water itself and improving the efficiency of propagation of the ultrasonic vibrations can be achieved as in the third preferred embodiment.

5. Modifications

While the aforementioned preferred embodiments have described that the substrate processing apparatuses 1 to 4 perform only the operation of removing particles, the substrate processing apparatus according to the present invention may be configured to perform other various kinds of operations.

Further, while the liquid supplied to the substrate(s) W is pure water in the aforementioned preferred embodiments, it may be any other liquid.

While the aforementioned preferred embodiments have described the cases where a gas dissolved in a liquid and a gas forming microbubbles are both nitrogen gas, any other gas such as carbon dioxide or ozone may be used instead. Or, a gas dissolved in a liquid and a gas forming microbubbles may be different kinds of gases.

Further, while the aforementioned first and second preferred embodiments have described the case where pure water overflowing to the external bath is discharged to the drain line, the configuration may be such that pure water overflowing to the external bath may be recirculated into the processing bath 10 after microbubbles and particles are removed therefrom. Such a configuration allows particle removal while saving the amount of pure water to be used.

While the invention has been shown and described in detail, the foregoing description is in all aspects illustrative and not restrictive. It is therefore understood that numerous modifications and variations can be devised without departing from the scope of the invention.

What is claimed is:

1. A substrate processing apparatus for processing a substrate using a liquid, said substrate processing apparatus comprising:

a processing bath for retaining a liquid, said processing bath having a bottom surface including at least two opposite sides;

a pair of discharge ports provided at the opposite sides of the bottom surface of said processing bath;

a holder for holding a substrate being immersed in the liquid in said processing bath;

a liquid supplier for supplying the liquid from the pair of discharge ports provided at the sides of the bottom surface of said processing bath to the inside of said processing bath and forming an upwardly directed liquid flow in said processing bath;

a propagation bath provided under said processing bath for retaining a propagation liquid, said propagation bath having a bottom surface including a back side;

an ultrasonic vibration applicator provided at the back side of the bottom surface of said propagation bath for applying ultrasonic vibrations to the liquid retained in said processing bath through said propagation bath;

a microbubble generator for generating microbubbles in the liquid supplied from said liquid supplier to said processing bath; and a controller for controlling each of the above parts to stop the application of ultrasonic vibrations and continue only the supply of the liquid containing microbubbles after a predetermined duration of the application of ultrasonic vibrations and the supply of the liquid containing microbubbles to said substrate being immersed in the liquid retained in said processing bath.

2. The substrate processing apparatus according to claim 1, further comprising:

a gas dissolver for dissolving a predetermined gas in the liquid supplied from said liquid supplier to said processing bath.

3. The substrate processing apparatus according to claim 2, wherein said gas dissolver dissolves nitrogen gas in the liquid supplied from said liquid supplier to said processing bath.

* * * * *